United States Patent [19]

Kopel

[11] Patent Number: 4,890,094

[45] Date of Patent: Dec. 26, 1989

[54] WALLET INCORPORATING CREDIT CARD ALARM SYSTEM

[76] Inventor: David Kopel, 10020-5 Larwin Ave., Chatsworth, Calif. 91311

[21] Appl. No.: 254,888

[22] Filed: Oct. 7, 1988

[51] Int. Cl.[4] ..... G08B 13/14

[52] U.S. Cl. ..... 340/571; 340/568

[58] Field of Search ..... 340/568, 569; 335/205, 335/206, 207, 306; 200/61.59, 61.63, 61.19; 250/151

[56] References Cited

U.S. PATENT DOCUMENTS 4,652,865 3/1987 Maharshak ..... 340/568

*Primary Examiner*—Michael J. Tokar

*Attorney, Agent, or Firm*—Freilich, Hornbaker, Rosen & Fernandez

[57] ABSTRACT

A nonrigid wallet structure formed by a flexible dielectric sheet carrying planar conductive material thereon and configured to define card accommodating compartments. The planar conductive material extends into the compartments and forms a card monitoring and alarm system.

11 Claims, 4 Drawing Sheets

WALLET INCORPORATING CREDIT CARD ALARM SYSTEM

FIELD OF THE INVENTION

This invention relates generally to nonrigid wallet structures formed of flexible sheet material and more particularly to such wallet structures which incorporate means for monitoring the absence of a credit card from a wallet compartment to produce an audible alarm.

BACKGROUND OF THE INVENTION

The concept of incorporating means in a wallet-like structure for monitoring the absence of a credit card from a compartment is well known.

For example, U.S. Pat. No. 3,959,789 discloses a card monitoring means that may be incorporated into a wallet for alerting the user after a card has been removed from its compartment and not returned after a predetermined length of time. The disclosed monitoring means includes a pair of separators mounted in each compartment. The separators carry opposed electrical conductors adapted to be held apart by a credit card accommodated in the compartment and adapted to contact one another when the credit card is removed from the compartment. The conductors are connected in a circuit including timing means which activates an alarm a predetermined time interval after a card is removed from its compartment.

U.S. Pat. No. 4,480,250 also discloses a credit card wallet incorporating a monitoring and alarm system. The wallet includes first and second flaps foldable upon each other. Each of the flaps carries clip switches adapted for receiving credit cards therein. The clip switches are electrically connected in parallel with each other and in series between an alarm and a battery. When a credit card is missing from one of the clip switches, the circuit between the battery and the alarm is completed and the alarm is energized. The flap also includes a proximity switch for disabling the alarm when the flaps are unfolded.

U.S. Pat. No. 4,692,745 also discloses a wallet incorporating a monitoring and alarm system for detecting the absence of a card from a compartment. The system includes a photoconductive means positioned on the inner portion of one of the wallet flaps for disabling the alarm when the wallet is open, i.e. flaps unfolded. When the wallet is closed to thus deprive the photoconductive means of light energy, the alarm will be activated if a card is missing from one of the wallet's compartments.

Although the systems disclosed in the aforementioned patents can all operate satisfactorily under appropriate conditions, they are subject to reliability problems when incorporated in wallets formed of flexible sheet material. More particularly, wallets formed of flexible sheet material are frequently carried in user's hip or side pockets where they are subjected to various forces which, over time, can distort the shape of the wallet and any malleable switch contacts therein, frequently resulting in a malfunctioning of the monitoring and alarm system.

SUMMARY OF THE INVENTION

The present invention is directed to an improved wallet structure incorporating a card monitoring and alarm system which can be manufactured inexpensively and is very reliable in use.

More specifically, the present invention is directed to a wallet structure comprised of a flexible sheet of dielectric (i.e. electrically nonconductive) material, e.g. mylar, having planar circuit paths formed thereon, as for example, by silkscreening. The dielectric sheet is folded accordion style to form pairs of opposed sheet portions or panels, each such pair defining a credit card compartment therebetween. The planar circuitry extends into each such compartment forming relatively large opposed conductive areas which contact one another in the absence of a card.

In accordance with a preferred embodiment of the invention, a wallet is formed of a single unitary sheet of dielectric material, bearing planar circuit paths on one surface thereof, and folded accordion style to form compartments for receiving documents such as credit cards, ID cards, etc., and wherein flexible sheet material, such as leather, is affixed around the dielectric sheet, as decorative trim.

In accordance with an important aspect of the preferred embodiment, the planar circuit paths are formed on a first or front surface of the dielectric sheet and resilient cushioning pads, are affixed to the second or rear surface of the dielectric sheet to facilitate contact between opposed conductive areas.

In accordance with a further aspect of the preferred embodiment, the monitoring and alarm system includes a sensor means for disabling the alarm while the wallet is open. The sensor means, in one embodiment, comprises a gap in the planar circuit path exposed on one flap of the wallet and a piece of electrically conductive material mounted on the other flap so as to electrically bridge the gap when the wallet is closed.

DETAILED DESCRIPTION

Figure 1:
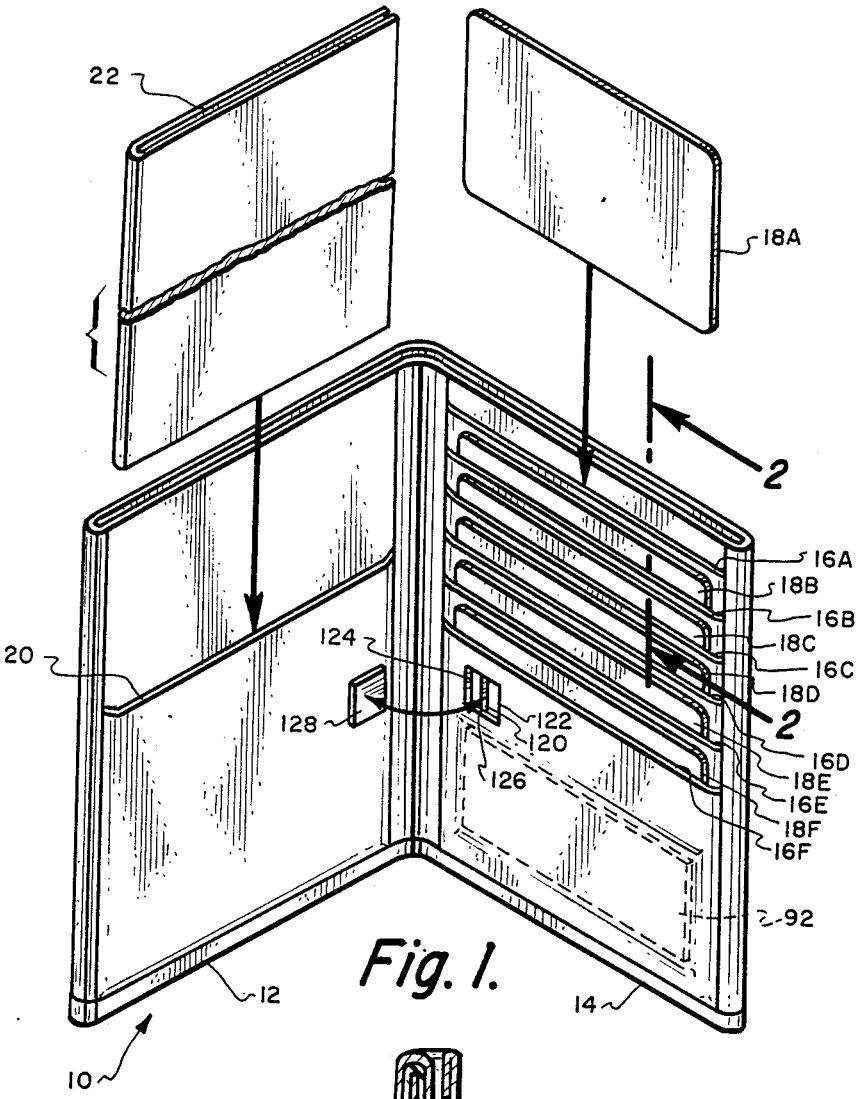
FIG. 1 is an isometric external view of a wallet constructed in accordance with the present invention.

Attention is initially directed to FIG. 1 which illustrates a wallet-like structure 10 comprised of first and second flaps 12, 14. The flaps 12, 14 are able to pivot relative to one another between a wallet open position (as shown in FIG. 1) and a wallet closed position in which the flaps overlay and contact one another.

The flaps 12 and 14 each define one or more card accommodating compartments, to be discussed in greater detail hereinafter, each compartment having an entrance opening. Thus, in the exemplary embodiment depicted in FIG. 1, flap 14 has multiple compartments 16 (i.e. 16A, 16B, 16C, 16D, 16E, 16F), each dimensioned to accommodate a document such as a credit or ID card 18 (i.e. 18A, 18B, 18C, 18D, 18E, 18F).

Flap 12 is similarly provided with a compartment 20 for similarly accommodating a card or a passport booklet 22. As will be discussed in detail hereinafter, the wallet structure 10 incorporates a system for monitoring empty compartments and alarming the user when a compartment is empty. The system is extremely useful for reminding a user when he has removed a credit card 18 or passport 22 from the wallet compartment.

Figure 3:
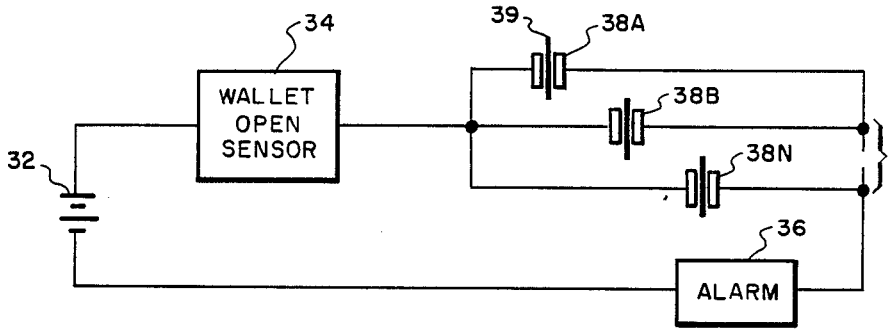
FIG. 3 is a schematic diagram of the monitoring and alarm system electric circuitry.

Before proceeding with a detailed explanation of the construction of wallet structure 10, attention is directed to FIG. 3 which schematically depicts a preferred monitoring and alarm system 30. It is pointed out that the circuitry of monitoring and alarm system 30, as broadly represented in FIG. 3, is substantially identical to circuitry of prior art systems, as exemplified by the aforementioned patents. Briefly, the system 30 is comprised of an electric source means or battery 32 connected in series with a wallet open sensor 34, and an alarm means 36, preferably an audible alarm. Further, a plurality of normally closed contact pairs 38A, 38B . . . 38N are connected in parallel with each other and in series with the battery 32, sensor 34, and alarm 36. As will be seen hereinafter, each of the contact pairs 38 is mounted in its own compartment in the wallet structure 10 and configured such that it is normally electrically closed, but is opened by a card 39 accommodated in the compartment.

Figure 4:
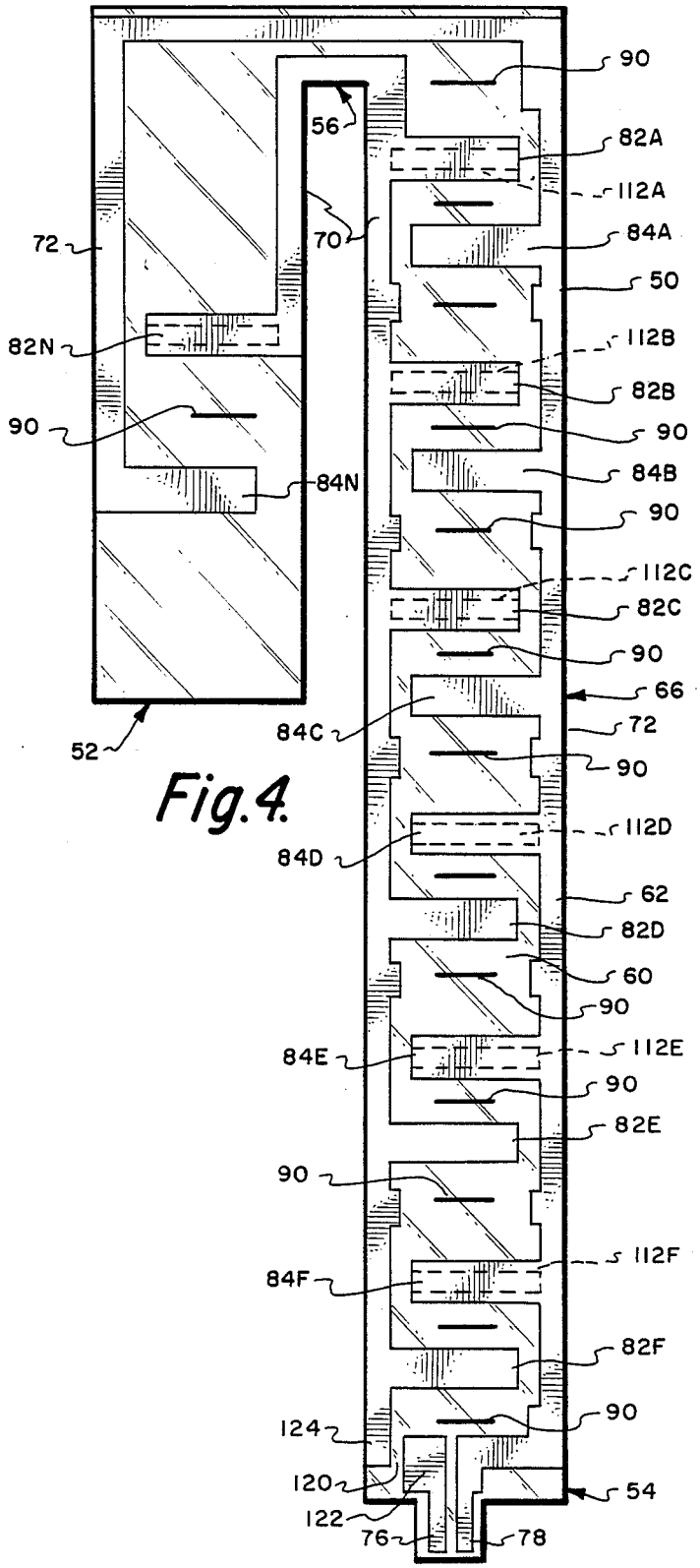
FIG. 4 is a plan view of the dielectric sheet, showing the planar conductive paths formed thereon, to construct the wallet of FIG. 1.
Figures 5, 6:
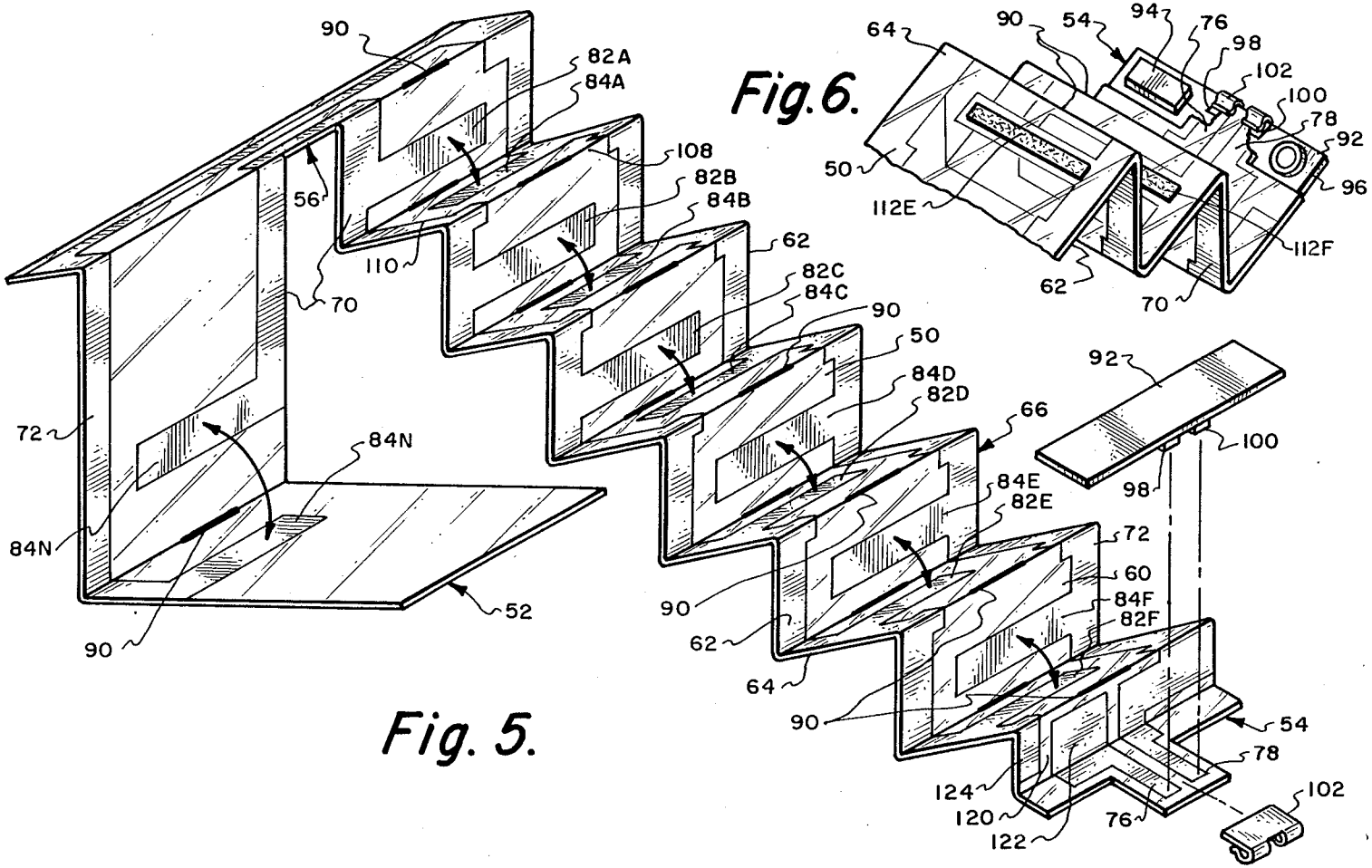
FIG. 5 is a isometric view of the dielectric sheet of FIG. 4 showing it folded accordion style.
FIG. 6 is an isometric view of a portion of the dielectric sheet showing how a battery and alarm device are preferably connected to the dielectric sheet planar circuit paths.

Attention is now directed to FIGS. 4–6 which illustrate the construction of wallet structure 10 in accordance with the present invention. The wallet 10 is comprised of a thin sheet of flexible dielectric material, e.g. mylar, 50. The dielectric sheet 50 is essentially U- or J-shaped having first and second leg portions 52, 54, and a cross member portion 56. As depicted, the leg portion 54 is longer than the leg portion 52 in order to accommodate a greater number of compartments (i.e. six) in flap 14 as contrasted with the single compartment formed in flap 12.

The dielectric sheet 50 comprises a planar member having front and rear surfaces 62 and 64. In accordance with the invention, planar electrically conductive material 66 is deposited onto the front surface 62 of dielectric sheet 50, as by silkscreening. The conductive material 66 forms an electrically conductive path including of a first bus 70 (extending upwardly along the left edge of leg portion 54 and then along cross member 56 and down along the right edge of leg portion 52) and a second bus 72 (extending upwardly along the right edge of leg portion 54, then along cross member 56, and down along the left edge of leg portion 52). The buses 70 and 72 terminate at the lower edge of leg portion 54 at terminals 76 and 78 respectively.

A plurality of first conductive areas 82A, 82B, 82C, etc., extend laterally from the first bus 70 toward the second bus 72. A plurality of conductive areas 84A, 84B, 84C, etc., extend laterally from the second bus 72 toward the first bus 70. The conductive areas 82 and 84 are interleaved to form pairs of spaced conductive areas, each pair having a first conductive area connected to the first bus 70 and a second conductive area connected to the second bus 72. Thus, for example, conductive areas 82A and 84A form a pair of spaced conductive areas. Similarly, conductive areas 82B and 84B form a pair of spaced conductive areas.

In order to construct the wallet 10, the leg portions 52 and 54 are folded, substantially accordion style as depicted in FIG. 5, to position the conductive areas of each pair in opposed relationship. More specifically, the dielectric sheet 50 is folded along fold lines 90 to form panels, each of which carries a conductive area. So folded, the opposed dielectric sheet panels form compartments for accommodating a credit card. For example, the opposed panels carrying conductive areas 82A and 84A form the compartment 16A in FIG. 1. Similarly, the panels bearing conductive areas 82N AND 84N on leg portion 52 when folded together define the compartment 20 in flap 12 of FIG. 1.

The flexible dielectric sheet 50, folded as depicted in FIG. 5, substantially forms a wallet structure having a plurality of credit card accommodating compartments with an integrated system for monitoring the absence of a card from a compartment to activate an alarm means. More specifically, in order to connect a battery 32 and an audible alarm 36 to the circuitry formed on the front surface 62 of sheet 50, a small printed circuit board 92 is provided. An audible alarm device 94 and a battery 96 are mounted thereon and electrically connected to circuit board terminal areas 98 and 100. The first and second bus terminals 76, 78 are electrically connected to the circuit board terminals 98, 100, as by a U-shaped spring clip 102 which clamps the terminals together.

Figure 2:
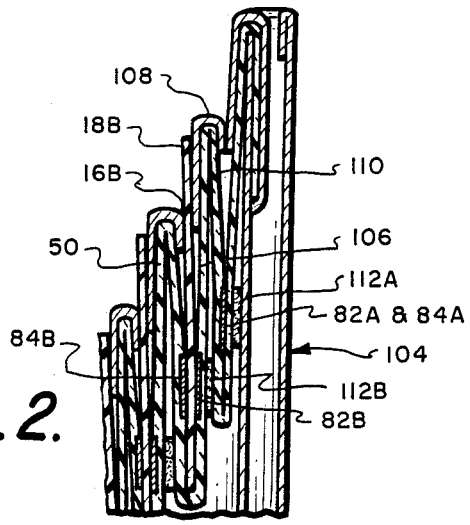
FIG. 2 is a sectional view taken substantially along the plane 2—2 of FIG. 1.

The dielectric sheet 50 can be tightly held in fan folded position as depicted in FIG. 2 to form the card accommodating compartments by various means including adhesive and/or stitching. Preferably, however, decorative flexible sheet material, e.g. leather 104, is secured around the dielectric sheet and over its exposed edges. More specifically, note dielectric sheet panel 106 in FIG. 2 carrying conductive area 82B. Panel 106 forms one side of the compartment 16B for receiving card 18B. Note that the upper edge of panel 106 is covered by a piece of decorative sheet material 108 which extends downwardly along panel 106 and similarly downwardly along panel 110 carrying conductive area 84A. With the dielectric sheet 50 tightly held as shown in FIG. 2, the opposed conductive areas, e.g. 82B, 84B will be placed immediately adjacent one another for electrical contact. In order to assure contact in the absence of a card therebetween, a plurality of resilient cushioning pads 112 are secured to the rear surface 64 of the dielectric sheet 50 behind one of the conductive areas. Thus, for example, note resilient cushioning pad 112B in FIGS. 2 and 4 which is secured to dielectric sheet surface 64 behind conductive area 82B for urging area 82B into contact with area 84B, in the absence of the card 18B therebetween.

It will be recalled from the description of FIG. 3 that when a card 39 is absent from between the areas of a contact pair, e.g. 38A, then a circuit will be completed from the battery 32 to the alarm 36, on the assumption that the sensor 34 is closed. The wallet open sensor can comprise a magnetically operated proximity switch which detects when two wallet flaps are in close proximity with one another or alternatively can comprise a photoconductor device which recognizes when the wallet is open. The purpose of the sensor 34 is to prevent actuation of the alarm 36 while the wallet is open even if a card is absent from one of the compartments. Although a proximity switch or photoconductor device located on the inside surface of a wallet flap, as taught by the prior art, could be employed in embodiments of the invention, a preferable sensor is depicted in applicant's embodiment as shown in FIGS. 1 and 4.

Figure 7:
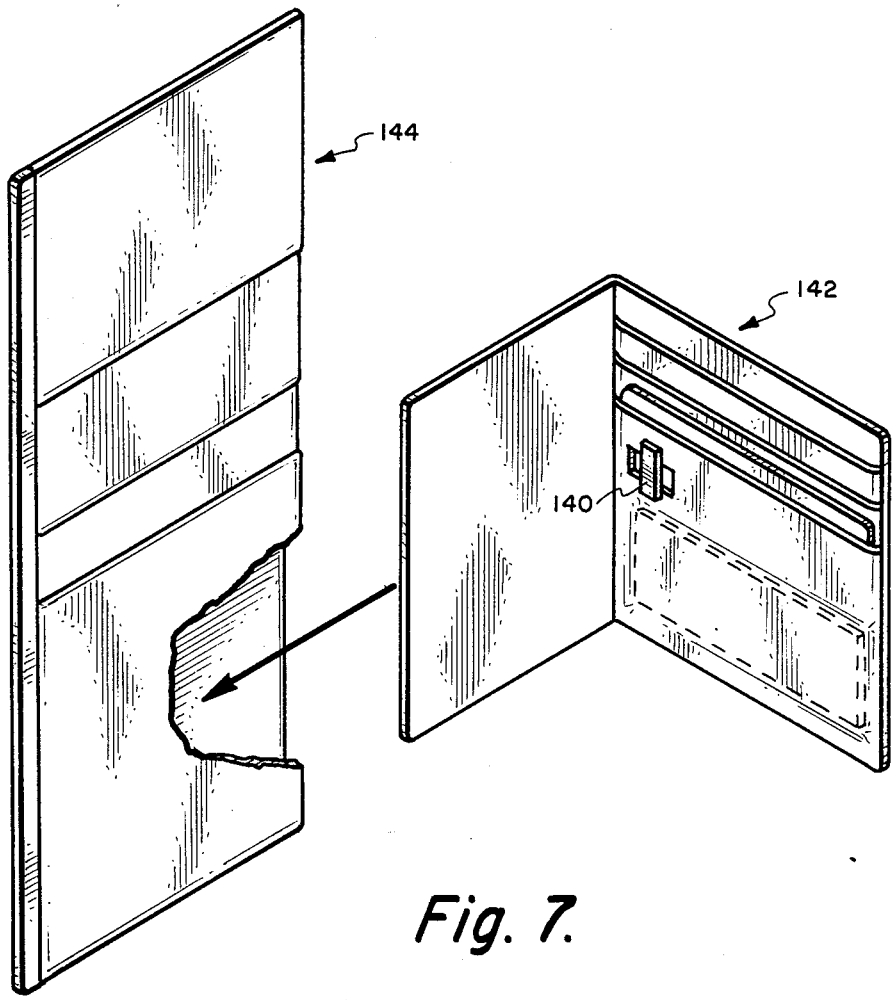
FIG. 7 is an isometric view of an alternative embodiment of the invention in which the monitoring alarm system is incorporated in a wallet insert.

Note in FIG. 4 that the first bus 70 includes a gap 120 formed between adjacent conductive portions 122 and 124. Note also that this gap 120 and conductive portions 122 and 124 are exposed through a window 126 formed on the inner surface of flap 14. Also note that the inner surface of flap 12 has a conductive member 128 mounted thereon located such that when the flaps 12 and 14 are closed, the conductive member 128 will contact and electrically bridge the conductive portions 122 and 124 of bus 70. Accordingly, when the flaps 12 and 14 are apart as depicted in FIG. 1, a circuit cannot be completed from terminal 76 along bus 70 through a contact area pair to bus 72 and back to terminal 78. However, when flaps 12 and 14 are closed so that member 128 electrically bridges conductive portions 122 and 124, a circuit can be completed from the battery 32 (structurally shown as 96 as FIG. 6) to alarm 36 (structurally shown as 94 in FIG. 6) via contacting conductive areas associated with an empty compartment, e.g. 82A and 84A. Thus the combination of the conductive member 128 and spaced conductive portions 122 and 124 form an inexpensive and highly reliable wallet open sensor 34. Alternatively, the function of sensor 34 could be performed by an inexpensive, pressure sensitive membrane switch, well known in the art. Such a membrane switch is depicted at 140 in FIG. 7 which shows an embodiment of the invention configured as an insert 142 adapted to be inserted into a conventional decorative wallet 144. A still further alternative is to mount a photoconductor device on the outer surface of a wallet flap. In this case, the alarm generally will not sound until the user puts the wallet in his pocket.

From the foregoing, it should now be appreciated that a nonrigid wallet structure has been disclosed herein formed of flexible sheet material incorporating means for monitoring the absence of a credit card from a wallet compartment to produce an audible alarm. As contrasted with prior art devices for monitoring the absence of cards from wallets, the present invention discloses a construction formed almost completely of flexible sheet material thereby avoiding the deformation and reliability problems experienced by prior art devices using conventional malleable switch contacts.

I claim:

1. A nonrigid wallet structure comprising:

a single sheet of flexible dielectric material having first and second surfaces;

planar electrically conductive means carried on said dielectric sheet first surface forming a circuit path including at least one pair of first and second conductive areas spaced from one another to define a gap therebetween;

means folding said dielectric sheet upon itself at said gap for forming a compartment wherein said first and second conductive areas are positioned opposite to one another;

resilient means including at least one resilient cushioning pad mounted on said dielectric sheet second surface for urging said first and second conductive areas into contact with one another; and decorative flexible sheet means mounted on and covering said dielectric sheet while leaving said compartments open for receiving cards therein.

2. The wallet structure of claim 1 wherein said dielectric sheet includes multiple pairs of spaced first and second conductive areas; and wherein said dielectric is folded accordion style to form multiple compartments, each compartment including a pair of first and second conductive areas positioned opposite to one another.

3. The wallet structure of claim 2 wherein said circuit path includes first and second buses; and wherein said multiple pairs of first and second conductive areas are electrically connected in parallel across said buses.

4. The wallet structure of claim 3 wherein said first and second buses respectively define first and second terminals;

electric source means;

alarm means; and means for connecting said electric source means and said alarm to said first and second terminals.

5. The wallet structure of claim 4 wherein said means connecting said electric source means and said alarm means to said bus terminals includes circuit board means having first and second terminals; and removable clip means for connecting said circuit board first and second terminals to said bus first and second terminals.

6. A nonrigid wallet structure comprising a single sheet of flexible dielectric material having first and second surfaces, said sheet being substantially U-shaped having first and second legs connected by a narrow cross member;

planar electrical conductors carried on said dielectric sheet first surface forming (1) first and second buses and (2) multiple pairs of first and second conductive areas spaced from one another to define a gap therebetween, said pairs being connected in parallel across said buses;

each of said dielectric sheet first and second legs being folded accordion style at said gaps to form multiple compartments, each compartment containing a pair of first and second conductive areas positioned opposite to one another;

cushioning pad means mounted on said dielectric sheet second surface proximate to said gaps for urging opposed first and second conductive areas into contact; and decorative flexible sheet means mounted on and covering said dielectric sheet while leaving said compartments open for receiving cards therein.

7. The wallet structure of claim 6 further including:

battery means;

alarm means; and means connecting said battery means and said alarm means to said buses for energizing said alarm means in response to a pair of said first and second conductive areas contacting one another.

8. The wallet structure of claim 7 including first and second flaps respectively comprised of said first and second accordion folded legs, said flaps being adapted to fold around said cross member between a wallet closed position and a wallet open position; and sensor means for disabling said alarm means when said flaps are in said wallet open position.

9. The wallet structure of claim 8 wherein said sensor means comprises a gap in said first bus on said first flap and conductive means carried by said second flap for electrically bridging said gap when said flaps are in said wallet closed position.

10. A method of assembling a wallet having exposed surfaces of leather or the like, comprising the steps of:

applying planar electrically conductive material to a first surface of a sheet of flexible dielectric material to form a circuit path including at least one pair of first and second conductive areas spaced from one another to define a gap therebetween;

folding said dielectric sheet first surface upon itself at said gap to form at least one compartment having a closed bottom edge, open side edges, and an open top edge with said first and second conductive areas positioned opposite one another;

applying a resilient cushioning pad to a second surface of said sheet of dielectric material for urging said first and second conductive areas into electrical contact with each other;

mounting alarm circuitry on said sheet of dielectric material for producing an audible alarm when said first and second conductive areas contact each other; and enveloping said folded dielectric sheet with sheet material of leather or the like, said sheet material closing the side edges of said compartment enabling cards to be received in said compartment to space said conductive areas from each other.

11. The method of claim 10 including the further steps of:

forming said dielectric sheet into a substantially U-shape having first and second legs connected by a narrow cross member; and wherein said folding step comprising folding each of said first and second legs in accordion fashion to respectively form first and second flaps adapted to fold around said cross member to a closed position; and disabling said alarm circuitry when said flaps are in said closed position.

* * * * *